US008210065B2

(12) United States Patent
Howell et al.

(10) Patent No.: US 8,210,065 B2
(45) Date of Patent: Jul. 3, 2012

(54) OUT-OF-PLANE CONFIGURATION-ADJUSTING MECHANISM, SYSTEM, AND METHOD

(75) Inventors: Larry L. Howell, Orem, UT (US); Brian Geoffrey Winder, Ridgecrest, CA (US); Erik Kent Bassett, Cambridge, MA (US); Allen Boyd Mackay, Flagstaff, AZ (US); Spencer P. Magleby, Provo, UT (US)

(73) Assignee: Brigham Young University, Provo, UT (US)

( * ) Notice: Subject to any disclaimer, the term of this patent is extended or adjusted under 35 U.S.C. 154(b) by 1020 days.

(21) Appl. No.: 12/172,992

(22) Filed: Jul. 14, 2008

(65) Prior Publication Data

US 2009/0013813 A1 Jan. 15, 2009

Related U.S. Application Data

(60) Provisional application No. 60/959,422, filed on Jul. 14, 2007.

(51) Int. Cl.
*G05G 1/00* (2008.04)
*B21K 21/16* (2006.01)

(52) U.S. Cl. ..... 74/469; 29/401.1

(58) Field of Classification Search ..... 29/401.1; 74/469; 251/118, 902; 267/159, 160; 359/224
See application file for complete search history.

(56) References Cited

U.S. PATENT DOCUMENTS 6,983,924 B2 * 1/2006 Howell et al. ..... 251/118

* cited by examiner

*Primary Examiner* — John C Hong
(74) *Attorney, Agent, or Firm* — Kunzler Law Group

(57) ABSTRACT

Configuration-adjusting mechanisms include linkages interconnecting first and second layers of a sheet material. The linkages have hinges positioned and oriented to cause motion of at least a portion of the linkages out of a plane of the first and second layers when the mechanisms are actuated. An apparatus, system, and method include one or more of the mechanisms for changing a contour of a surface provided by a cover overlying the mechanisms. An array of mechanisms or mechanisms corresponding to an array of positions on the surface may be selectively actuated to change the contour or texture of the surface. The array of mechanisms for changing the contour can provide user interface buttons selectively actuated by the mechanisms, which cause the buttons to emerge from the surface. A reconfigurable contour may be provided by selectable sets of the buttons associated with respective functions of a control panel, for example.

20 Claims, 6 Drawing Sheets

OUT-OF-PLANE CONFIGURATION-ADJUSTING MECHANISM, SYSTEM, AND METHOD

CROSS-REFERENCES TO RELATED APPLICATIONS

This application claims priority to U.S. Provisional Patent Application No. 60/959,422 entitled "OUT-OF-PLANE MORPHING MECHANISM" and filed on Jul. 14, 2007 for Larry L. Howell et al., which is incorporated herein by reference.

FIELD OF THE INVENTION

This invention relates to mechanisms for changing a texture or contour of a surface and more particularly relates to mechanisms configured move at least a portion thereof from a position in a plane to a position extending out of the plane.

BACKGROUND

There are many mechanisms that provide changeable contours on a surface. For example, spring biased buttons on an electronic control device, or keys on a keyboard are capable of being depressed and released. Other buttons have stable positions and remain depressed once moved. These buttons are supported and moved by a variety of mechanical elements, including rigid joint elements forming linkages. For the particular case of an element of a mechanism moving from within a plane to a location outside the plane, J. J. Parise describes ortho-planar mechanisms. (See Parise, J. J., Howell, L. L., and Magleby, S. P., 2000. "ORTHO-PLANAR MECHANISMS." In *Proceedings of the* 2000 *ASME Design Engineering Technical Conferences*.)

Most springs are compliant elements that can be collapsed under force and return to their original position when released. These springs are typically one-piece, and are usually disposed in abutment with a base element on one end and an element to be biased on the other end.

Linkages and other mechanisms for changing configurations and/or applying a force by actuation are well known for most mechanical design regimes. An example of a micro level device that has a configuration-changing mechanism is described by C. P. Lusk in his 2005 PhD dissertation. (See Lusk, C. P., 2005. "ORTHO-PLANAR MECHANISMS FOR MICROELECROMECHANICAL SYSTEMS." PhD Dissertation, Brigham Young University, Provo.) Lusk's device is an ortho-planar mechanism for microelectromechanical systems.

Compliant system design and analysis has been addressed by L. L. Howell. (See Howell, L. L., 2001. "COMPLIANT MECHANISMS." John Wiley & Sons, New York.)

An area of deficiency is highlighted by the fact that many input devices have arrays of push buttons for user input that are too complicated or are otherwise inadequate and/or awkward to use. For example, as electronics have become smaller and more complex, their input devices must be fit into smaller footprints or must utilize alternate functions for the same buttons such as through an "Alt" key.

The known mechanisms forming these input devices have not adequately addressed needs for greater compactness, cost savings, ease of manufacture, and more sophisticated results through manipulation of elements of input devices for the purpose of adjusting a configuration of the input device.

SUMMARY

From the foregoing discussion, it should be apparent that a need exists for an apparatus, system, and method that has a low profile, is light weight, costs little to manufacture, and is capable of being reconfigured into a desired configuration. Beneficially, such an apparatus, system, and method would enable plural arrays of positions on a surface or plane to be independently or dependently moved. Accordingly, the present invention overcomes many or all of the above-discussed shortcomings in the art.

In a simple form, a mechanism in accordance with embodiments of the present invention is capable of being transformed from a planar to a non-planar configuration. The mechanism includes a first layer and a second layer. The mechanism also includes at least one linkage interconnecting the first and second layers. The layers are flat and generally define a plane in a first of two stable positions. A portion of at least one of the layers projects out of the plane in the second of the two stable positions.

The layers may be compliant, and the linkage may include a portion of at least one of the first and second layers. The linkage may be a first linkage of a plurality of linkages that interconnect the first and second layers. In one embodiment, the mechanism is a spherical mechanism. The mechanism may include at least one bi-stable biasing mechanism for biasing the second layer into each of the two stable positions relative to the first layer.

In another simple form, embodiments of the invention include an apparatus for changing a position or contour of a surface. The apparatus includes at least one configuration changing mechanism having first and second layers coupled together and movable relative to each other. In one embodiment, a cover is supported on the at least one mechanism. A surface on the cover has a first position on the cover that is adjustable to a second position by moving the at least one mechanism from a first configuration to a second configuration.

The apparatus may include a plurality of similar mechanisms. The apparatus may also include at least one actuator that is coupled to the configuration changing mechanism or mechanisms. The actuator may be configured to move the first and second layers of the mechanism(s) between first and second positions. In embodiments having a plurality of configuration changing mechanisms, the apparatus may include a plurality of actuators. The actuators may be coupled to respective distinct sets of the configuration changing mechanisms among the plurality of configuration changing mechanisms for selectively moving the distinct sets of configuration changing mechanisms. The plurality of actuators may be independently coupled to the configuration changing mechanisms and configured to independently actuate the respective sets of configuration changing mechanisms. Alternatively, the actuators may be coupled in a dependent manner such that actuation of one set may preclude actuation of another set, or actuation of a set may cause actuation of another set.

In still another simple form, a system in accordance with embodiments of the invention includes a configuration-adjusting mechanism. The system includes a base layer and an actuation layer movably coupled to the base layer. At least one linkage is coupled to each of the base layer and the actuation layer. An actuator is coupled to the actuation layer for moving the actuation layer between first and second positions. The base layer, actuation layer, and at least one linkage form an ortho-planar configuration-adjusting mechanism.

The actuation layer may be rotatably coupled to the base layer. Two or more of the base layer, the actuation layer, and the at least one linkage may form a spherical mechanism. One or more of the base layer, actuation layer, and linkage may form a compliant mechanism. The first and second positions may be stable positions. The system may further include a biasing mechanism in which the biasing mechanism, base layer, actuation layer, and one or more linkage form a bi-stable mechanism for moving the actuation layer between the first and second positions.

The system may further include an electronic device or control panel. The electronic device or control panel may include a housing. The ortho-planar configuration-adjusting mechanism may be supported on the housing.

The system may further include a plurality of linkages. The plurality of linkages may be configured to extend transversely from a plane of the ortho-planar configuration-adjusting mechanism. Thus, the plurality of linkages may correspond to an array of positions in the plane or on a surface of the housing.

In one embodiment, the plurality of linkages may include at least a first set of the linkages in the array of positions and a second set of linkages in the array of positions. The first and second sets of linkages may be operatively connected to the actuator(s) for independent actuation of the first and second sets of the linkages in the array of positions. Alternatively or additionally, the plurality of linkages include at least one set of linkages in the array of positions dependently coupled to another set of linkages in the array of positions for dependent actuation or movement of the sets of the linkages in the array of positions.

In another embodiment, the array of positions comprises a plurality of patterns. The system may further include a first set of linkages corresponding to one of the patterns and a second set of linkages corresponding to another of the patterns.

In still another simple form in accordance with embodiments of the invention, a method for changing a configuration includes forming a linkage from at least two layers of sheet material. The method also includes causing the linkage to move from a plane generally corresponding to the layers to a position extending transverse to the plane. The operation of causing includes one or more of mechanically and electrically actuating the linkage to move at least a portion of one of the layers relative to the other of the layers.

The method may include biasing the portion of the one of the layers into the position extending transverse to the plane. The position extending transverse to the plane may be a first stable position. The portion may have a second stable position corresponding to the portion being in the plane. The method may also include selectively moving the portion between the first and second stable positions.

The method may further include causing a plurality of linkages to move from the plane to a position extending transverse to the plane in which the plurality of linkages corresponds to an array of positions in the plane. The operation of causing the plurality of linkages to move may include moving at least one set of the linkages in the array of positions independently of another set of the linkages in the array of positions. Alternatively or additionally, the operation of causing a plurality of linkages to move may include moving at least one set of linkages in the array of positions dependent on actuation or movement of another set of the linkages in the array.

In one embodiment, the array of positions may include a plurality of patterns. The method may thus further include selectively causing a first set of linkages corresponding to one of the patterns to move and a second set of linkages corresponding to another of the patterns to move.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any manner in one or more embodiments. It is to be understood that the invention may be practiced without one or more of the specific features or advantages of a particular embodiment. Additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

More particular descriptions of examples of the embodiments briefly described above are set forth with reference to the appended drawings. These drawings depict examples and are not to be considered to be limiting of its scope.

DETAILED DESCRIPTION

Figure 1A:
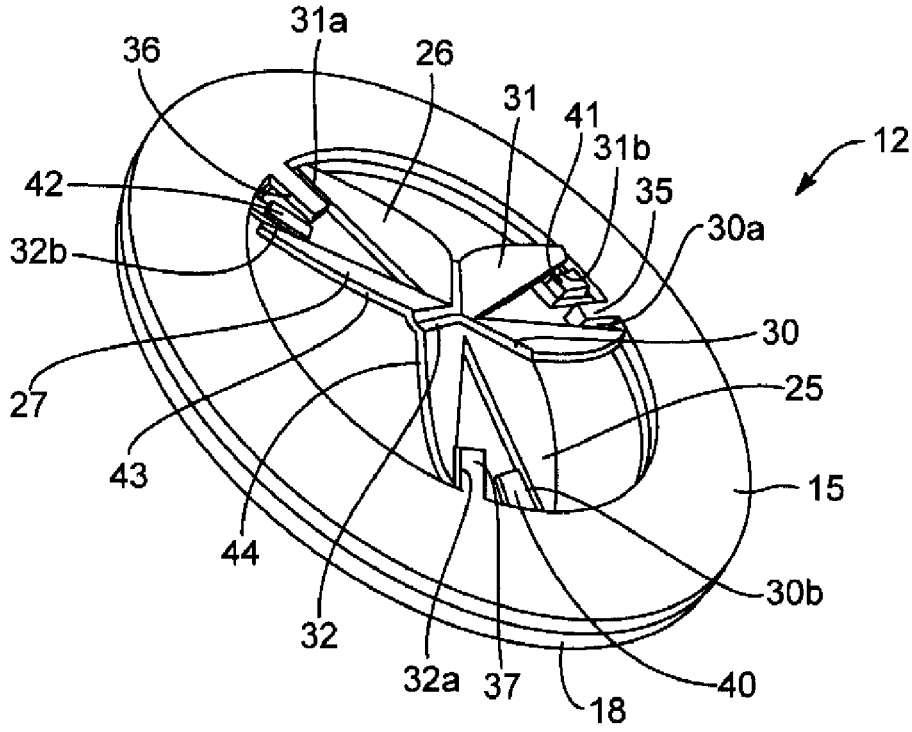
FIGS. 1A and 1B are diagrammatic perspective views of an embodiment of a mechanism for changing a configuration with the mechanism shown in respective first and second configurations.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of user selections, etc., to provide a thorough understanding of embodiments of the invention. However, the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Several terms are used in this specification that have definitions that are known in the art. However, several definitions are set forth here for clarity. The term "compliant" as used herein in reference to mechanisms or portions of mechanisms refers to mechanisms that gain some or all of their motion through the deflection of flexible members. The term "orthoplanar" refers to mechanisms in which all the links can be located in a single plane and having motion out of the plane. The term bi-stable refers to mechanisms whose total potential energy curves have two minima. That is, bi-stable mechanisms have two stable equilibrium configurations or states. The term "planar" as it refers to "mechanisms" refers to mechanisms that have joint axes that always remain parallel. At the same time, the bars of a straight-barred linkage of a planar mechanism remain in the same general plane. The term "spherical", as it refers to a mechanism, refers to a mechanism with joint axes all intersecting at a single point. Thus, the links of a spherical mechanism travel along a spherical surface centered at the joint axis intersection.

Embodiments of the present invention may include principles of lamina emergent mechanisms (LEMs). LEMs are mechanical devices that are fabricated from a planar material (a lamina) and that have motion that emerges out of the fabrication plane. LEMs achieve their motion from the deflection of flexible members. Thus, LEMs are compliant mechanisms. They are also monolithic. LEMs have the potential to perform sophisticated mechanical tasks with simple topology. Furthermore, the ability to fabricate LEMs from planar layers of material makes it possible to manufacture them by using simplified sheet material processes. Hence, high-performance, compact devices can be fabricated at low manufacturing cost. On the other hand, LEMs present challenging design issues, some of which are beginning to be addressed though innovative activities including those associated with the embodiments of the present invention.

Figure 1B:
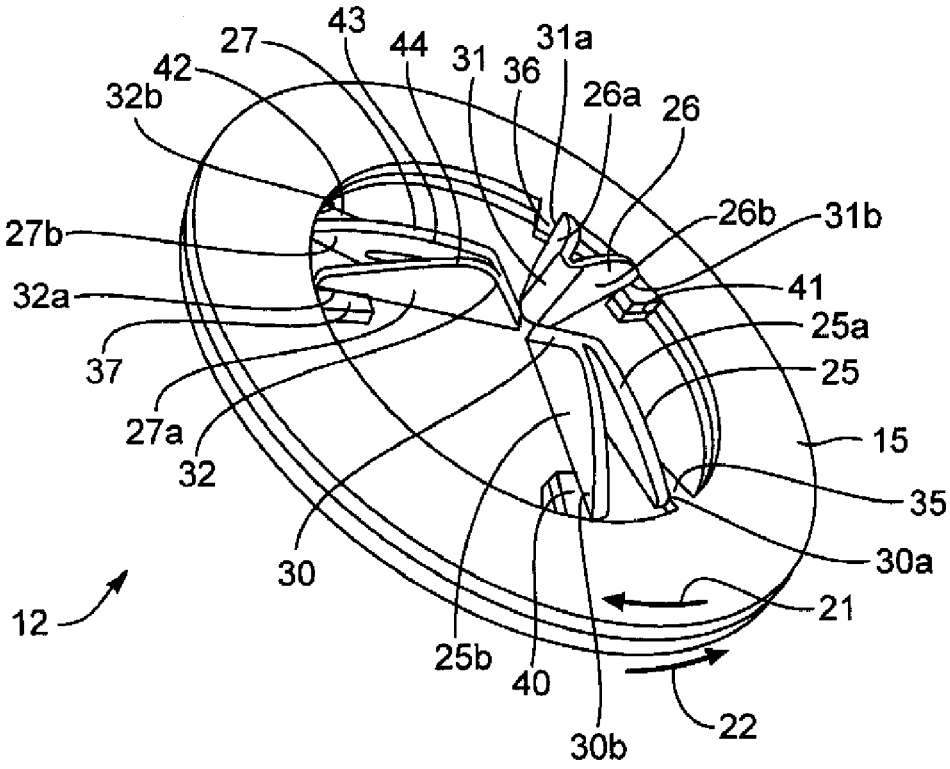

As stated, FIGS. 1A and 1B are diagrammatic perspective views of an embodiment of a configuration-adjusting mechanism 12 for changing a configuration by the mechanism 12 shown in respective first and second configurations. The perspective view of FIG. 1A shows the mechanism 12 in a non-deployed state or configuration, whereas FIG. 1B shows the mechanism 12 in the deployed state or configuration.

Figure 3A:
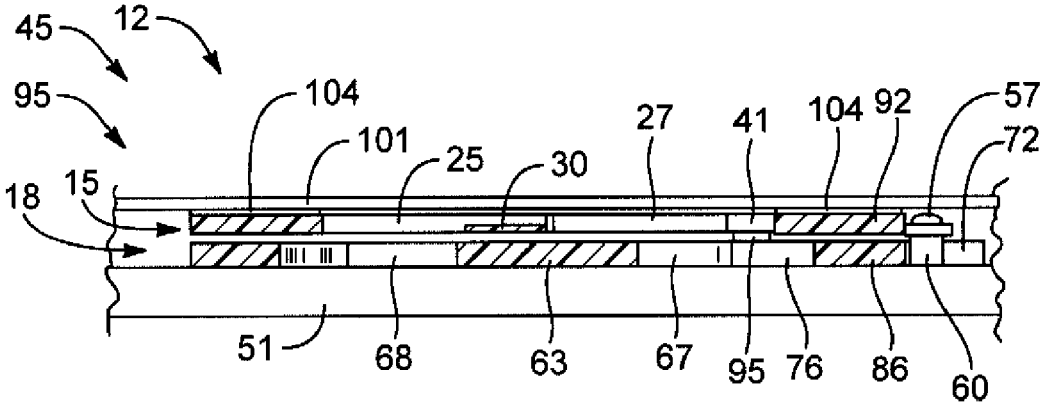
FIG. 3A is a diagrammatic sectional view taken along a line III-III of FIG. 1C with the mechanism in a non-deployed flat configuration.
Figure 3B:
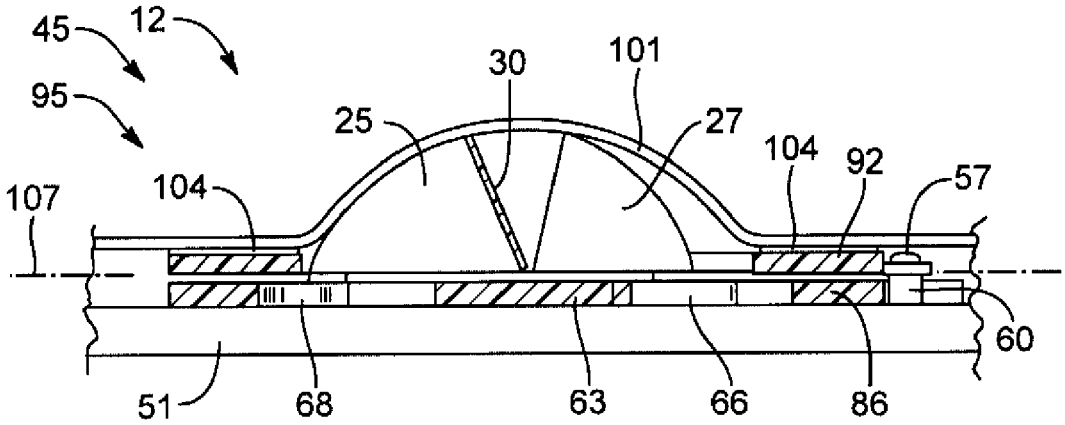
FIG. 3B is a diagrammatic sectional view similar to FIG. 3A with the mechanism in a deployed configuration with portions of the linkages extending out of a plane of the layers.

The mechanism can be formed to create two layers 15, 18 of flexible sheet material, though a third layer of thin flexible material may be added on top for aesthetic purposes, as will be describe with reference to FIGS. 3A and 3B. The two layers 15, 18 of the example mechanism 12 may be made of polypropylene or any other flexible or semi flexible sheet material. The layers 15, 18 are movably coupled together for constrained relative motion that enables shifting between the non-deployed and the deployed states. The relative motion is indicated by arrows 21, 22 in FIG. 1B.

As shown, three bifurcated linkages 25, 26, 27 move from a flat configuration shown in FIG. 1A to a bent, raised configuration shown in FIG. 1B when the layers 15, 18 are moved relative to each other in the direction of one or both of the arrows 21, 22. The structure and motion of the linkages 25, 26, 27 are generally that of slider-cranks, and in the specific example of this embodiment, the structure forms a spherical slider-crank. Other linkages forming other mechanisms of motion including planar slider-cranks may be incorporated in place of the linkages 25, 26, 27. However, the linkages 25, 26, 27 have hinges 30, 31, 32 formed by a thinned region that creates living hinges. The hinges 30, 31, 32 have hinge axes oriented to cause motion of at least portions of the linkages 25, 26, 27 out of a plane generally corresponding to the two layers 15, 18 when the linkages are moved from the non-deployed configuration to the deployed configuration. In one embodiment, the hinge axes all converge at a common point to form a spherical configuration-adjusting mechanism. As can be noted from FIGS. 1A and 1B, a first half 25*a* moves toward a second half 25*b* as the layer 15 is rotated in the direction of arrow 21. Similar motion is simultaneously caused between first and second bifurcated portions 26*a*, 26*b* and 27*a*, 27*b*. Additional living hinges 30*a*, 30*b*, 31*a*, 31*b*, 32*a*, 32*b* may also be formed by thinned regions to enable the linkages 25, 26, 27 to bend and move out of the plane.

As shown, the upper layer has ring tabs 35, 36, 37 that are integral with and extend radially inwardly. The ring tabs 35, 36, 37 are integrally connected by living hinges 30*a*, 31*a*, and 32*a* to the linkages 25, 26, 27, respectively. The ring tabs 35, 36, 37 also form part of the linkages 25, 26, 27, respectively. Similarly, lower layer 18 has actuation layer ring tabs (shown in FIG. 2A) to which linkage tabs 40, 41, 42 are coupled. Thus, when the upper layer 15 is rotated in a direction of arrow 21, the ring tabs 35, 36, 37 move with the upper layer 15 while the linkage tabs 40, 41, 42 remain in position with the lower layer 18, as shown in FIG. 1B. The linkages 25, 26, 27 have inner edges shown in the configuration of FIG. 1A that move and form an arcuate framework extending out of the plane when moved to the configuration of FIG. 1B. Other frameworks having other dimensions and other configurations may be achieved by placing and orienting the hinges according to predetermined specifications. In the embodiment of FIGS. 1A and 1B, the relative motion of the layers for actuation is rotational motion. Other motion may be implemented with other framework configurations and other embodiments.

Figure 1C:
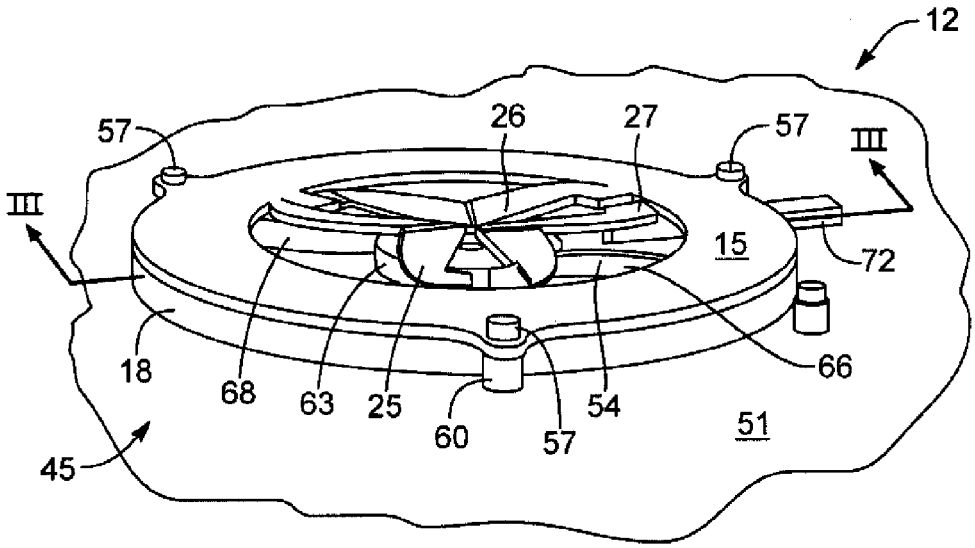
FIG. 1C is a perspective view of the embodiment of FIGS. 1A and 1B having a base layer and an actuation layer mounted on a surface and including a bi-stable biasing mechanism.

FIG. 1C is a perspective view of an apparatus 45 including the configuration-adjusting mechanism 12 in accordance with the embodiment of FIGS. 1A and 1B, although the mechanism 12 in FIG. 1C is actuated by reverse motion relative to the embodiment shown in FIGS. 1A and 1B. The mechanism 12 has the first layer 15 as a base layer and the second layer 18 as an actuation layer with the layers 15, 18 mounted on a mounting surface 51. The mechanism 12 also includes a bi-stable biasing mechanism 54 (more clearly shown in FIG. 2A). The apparatus 45 includes a mounting mechanism including fasteners 57 and spacers 60 for securing the base layer 15 to the actuation layer 18 in a slightly spaced relation, or at least to enable sliding movement between the layers 15, 18. The base layer 15 is fixed to the mounting surface and the actuation layer 18 is retained within the spacers for rotational movement relative to the base layer 15. The bi-stable biasing mechanism 54 forms part of the actuation layer 18 and includes a hub 63 that is also fixed to the mounting surface by fastener(s) and/or adhesive. Thus, the actuation layer 18 is rotated relative to the base layer 15 and the mounting surface 51. The resilient members 66, 67, 68, 69 are flexed as they move from a first stable position through an unstable range to a second stable position. These resilient members 66, 67, 68, 69 and the hub 63 may be cut from sheet material at the same time and may be formed as integral parts of the actuation layer. The resiliency and flexibility of the resilient members may be established by selecting a predetermined thickness for the resilient members 66, 67, 68, 69.

In one embodiment, the mechanism 12 uses three spherical slider-crank mechanisms formed by linkages 25, 26, 27 which are coupled so that a single input through a lever 72 actuates all three mechanisms or linkages 25, 26, 27 simultaneously. When the mechanism 12 is actuated by a rotational input, the linkages 25, 26, 27, or portions thereof, move out of the plane to increase the height of the mechanism 12. A height of a local surface (shown in FIGS. 3A and 3B) engaged by the mechanism 12 is also increased. The reason this configuration-adjusting mechanism 12 moves out-of-plane in this way is that the hinge axes 30, 31, 32 for the spherical slider-cranks all intersect at a single point, (which is the center of the sphere). Other non-spherical configurations can be implemented to cause movement of linkages out or the plane without limitation.

Figure 2A:
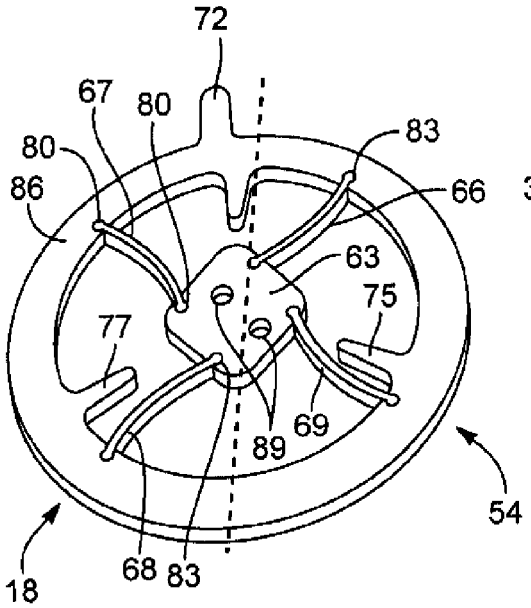
FIG. 2A is a top perspective view of the actuation layer that includes the biasing mechanism of FIG. 1C.

FIG. 2A is a top perspective view of the actuation layer 18 that includes the biasing mechanism 54 of FIG. 1C. FIG. 2A also clearly shows actuation layer ring tabs 75, 76, 77 to which the linkage tabs 40, 41, 42 shown in FIGS. 1A, 1B, and 2B are fixed during assembly.

As shown in FIG. 2A, bi-stable biasing mechanism 54 provides stability with four resilient members 66, 67, 68, 69, although any other number of resilient members could be incorporated. The resilient members 66, 67, 68, 69 are curved in a relaxed state. These resilient members are flexible and may be integrally formed as one piece with the rest of the actuation layer 18. Alternatively, the resilient members 66, 67, 68, 69 may be pinned-pinned links having an integral lobe 80 or pin at each end of each resilient member 66, 67, 68, 69 to be received in sockets 83 in the hub 63 at one end and in sockets 83 of an outer ring 86 of the actuation layer 18. These resilient members 66, 67, 68, 69 are compressed and/or bent when the outer ring 86 is moved through a mid-range of its rotational motion. The resilient members 66, 67, 68, 69 are elongated again when the outer ring 86 continues to rotate past the mid-range to another stable position. Thus, the stable positions for the biasing mechanism 54 and the configuration-adjusting mechanism 12 are at positions in which the resilient members are generally relaxed. This relaxed condition may be an uncompressed state in which the resilient members were manufactured. The resilient members 66, 67, 68, 69 thus form springs that are moved between relaxed and compressed or bent states. In this embodiment, the hub 63 of the bi-stable biasing mechanism 54 is configured to be attached to the mounting surface by fasteners extending through holes 89.

Figure 2B:
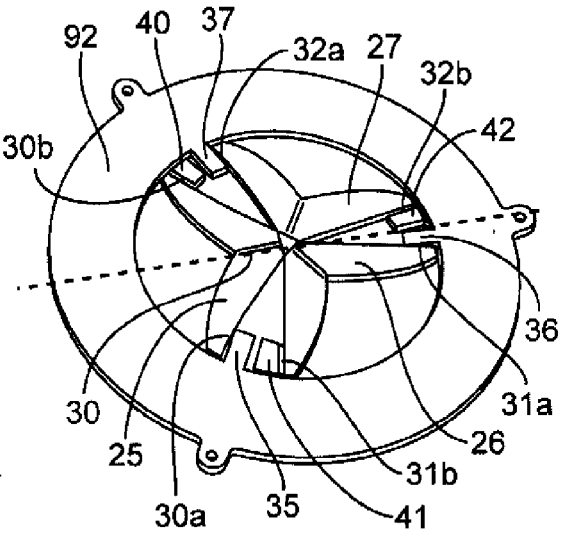
FIG. 2B is a top perspective view of the base layer including a plurality of linkages.

FIG. 2B is a top perspective view of the base layer 15 including the plurality of linkages 25, 26, 27 connected to a base outer ring 92 by living hinges 30*a*, 31*a*, 32*a* and ring tabs 35, 36, 37 that are formed integrally or as one piece with the base outer ring 92. The linkages 25, 26, 27 have linkage tabs 40, 41, 42 that are at opposite ends of the bifurcated linkages 25, 26, 27 from the ring tabs 35, 36, 37. The linkage tabs 40, 41, 42 are connected to the rest of the linkages 25, 26, 27 by flexible living hinges 30*b*, 31*b*, 32*b*. As described above, the linkage tabs 40, 41, 42 are to be fixed to the actuation layer ring tabs 75, 76, 77 such that relative rotational movement between the layers 15, 18 generally folds the bifurcated linkages 25, 26, 27 in half out of the plane.

In the illustrated embodiment, this mechanism 12 is fully-compliant, and uses very thin flexures in the form of living hinges between relatively stiff members to achieve a predetermined motion. As shown in FIG. 1B, the linkages 25, 26, 27 have structure that curves downward from a middle to outer edges of the linkages when the mechanism 12 is in the raised or deployed configuration. This allows the mechanism to create an aesthetically pleasing curved surface when covered with a flexible material cover, as shown in FIGS. 3A and 3B.

FIG. 3A is a diagrammatic sectional view taken along a line III-III of FIG. 1C with the configuration-adjusting mechanism 12 in a non-deployed, flat configuration. The linkages 25, 26, 27 naturally tend toward the flat state since that is the state in which the mechanism 12 is manufactured. The mechanism 12 also has the bi-stable biasing mechanism 54 in a flat configuration in the actuation layer 18. The base layer 15 is secured to the mounting surface 51 by fasteners 57 extending through spacers 60. FIG. 3A shows the linkage tab 41 fixed to the actuation layer ring tab 76 by an adhesive 95. Additionally or alternatively, other coupling mechanisms could be used. The other linkage tabs 40, 42 and actuation layer ring tabs 75, 77 (not shown in FIG. 3A) may be similarly coupled to each other. The embodiment of FIGS. 3A and 3B shows the apparatus 45 and a system 98 incorporating the configuration-adjusting mechanism 12. As such, the apparatus 45 has a cover 101 that may be formed of a stretchable material such as plastic and/or fabric to accommodate expansion and contraction that occurs during the reconfiguration when the mechanism is shifted between configurations. The cover 101 may be secured to the base layer 15 by an adhesive 104 that forms an bonding annulus on an upper surface of the outer ring 92 of the base layer 15. Alternatively, the cover may be held in place by other attachment mechanisms and/or by a preformed structure of the cover itself. In any case, when the actuation layer 18 is moved relative to the base layer 15, the cover flexes upward into the contour-forming configuration shown in FIG. 3B.

FIG. 3B is a diagrammatic sectional view similar to FIG. 3A with the mechanism 12 in a deployed configuration with portions of the linkages 25, 27 extending out of the plane of the layers 15, 18, (which plane is generally indicated by axis 107 in FIG. 3B).

It is to be understood that the configuration-adjusting mechanism 12 may be designed and configured to fit any of a variety of applications. The mechanism specifications may be changed to suit a particular application. This customization is not trivial because the design requirements and analysis, including modeling are at a higher, more challenging level than those mechanisms that can be modeled with linear methods or FEA. This is, in part due to the rigors of designing mechanisms capable of forming sophisticated or complex contours of textures from sheet material. While the linkages have been shown and described as being monolithic and/or compliant, it is to be understood that in some applications and embodiments, all or part of the mechanism 12 may be replaced by non-compliant elements such as rigid element joints at hinge points.

In creating the configuration-adjusting mechanism 12 for a particular application, it is important to know key output parameters, such as total height required, total actuation torque, total lifting force, and maximum size. Creating a mechanism 12 tailored to these needs calls for selection of a geometry and/or materials in order to get the correct overall torque characteristics with the correctly sized mechanism 12. Possible geometry changes include the length, width, and height of the linkages 25, 26, 27, the resilient members 66, 67, 68, 69 of the bi-stable mechanism 54, and the flexibility of the living hinges between portions of the linkages 25, 26, 27, 28. When a particular combination does not meet particular criteria, alternative materials may be selected or other factors adjusted for achieving the proper strength and stiffness characteristics.

One reason for changing geometry and/or materials is for the purpose of scaling a size, strength, and/or stiffness up or down while still retaining bi-stable characteristics. Scaling may be implemented to preserve other characteristics or may be done while maintaining desired characteristics. By way of example, retaining the bi-stable characteristic while scaling up or down can be achieved by calculating the torque rotation curves for both the linkages 25, 26, 27 and the rotationally stable bi-stable biasing mechanism 12, and adding them together. If the resulting curve for the total torque input moves below zero, the configuration adjusting mechanism will tend to stay at the point where the torque is lowest, which is a stable equilibrium point, and which occurs once the resilient members have moved past their bent or compressed condition and have straightened out to their relaxed state. In this configuration, there is no potential energy. The mechanism 12 of the embodiments of FIGS. 1C-3A has another stable equilibrium position in the as-manufactured position (zero rotation). Thus, the mechanism 12 has two stable configurations. This has energy savings advantages since no force is required to hold the mechanism 12 in the non-deployed and the deployed states.

Many tools may be utilized in designing a particular mechanism in accordance with embodiments of the present invention. However, these tools have their limitations when confronting the complexities of the required designs. For example, compliant mechanisms require nonlinear analysis. Therefore, traditional techniques employing linear beam theory and linear finite element analysis (FEA) cannot accurately model the large motions incident to many compliant mechanisms. Furthermore, nonlinear FEA is too cumbersome to be useful in the initial stages of compliant mechanism design. Rather pseudo-rigid-body model (PRBM) has been developed for designing and analyzing compliant mechanisms. The PRBM models flexible members as rigid links connected by pin joints and torsional springs. This allows greatly simplified models suitable for use with traditional kinematics analysis techniques. The PRBM can be used extensively in the initial design stages, and combined with nonlinear FEA in later stages. (See Howell, L. L., 2001. "COMPLIANT MECHANISMS." John Wiley & Sons, New York.) For the case of spherical slider-crank linkages, spherical kinematics is considered to be more general than planar kinematics. Spherical mechanisms are much less common and more complicated to design than planar mechanisms. However, they offer unique opportunities for design. In this regard, closed form equations can be derived for spherical configurations using spherical trigonometry. (See Lusk, C. P., 2005. "ORTHO-PLANAR MECHANISMS FOR MICRO-ELECROMECHANICAL SYSTEMS." PhD Dissertation, Brigham Young University, Provo.) The advantage of utilizing these closed form equations is that doing so provides a very clean approach to design and analysis of spherical configuration-adjusting mechanisms and enables design of mechanisms having complex motions in very compact footprints.

Figure 4A:
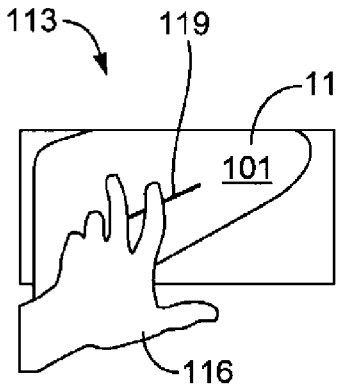
FIGS. 4A-4D are diagrammatic perspective views of an electronic control panel system incorporating the mechanism of FIGS. 1A-3B in which an application for the mechanism is depicted.
Figure 4B:
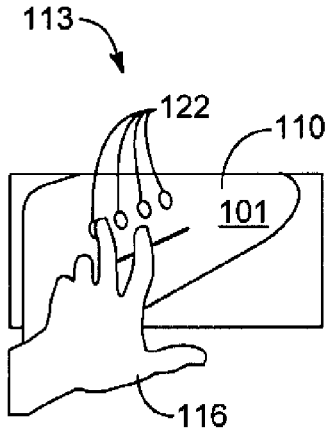
Figure 4C:
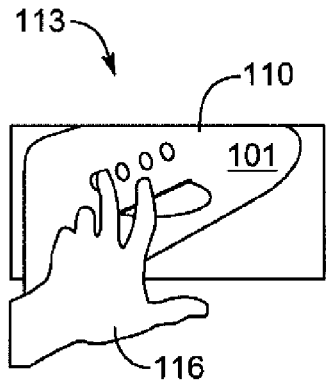
Figure 4D:
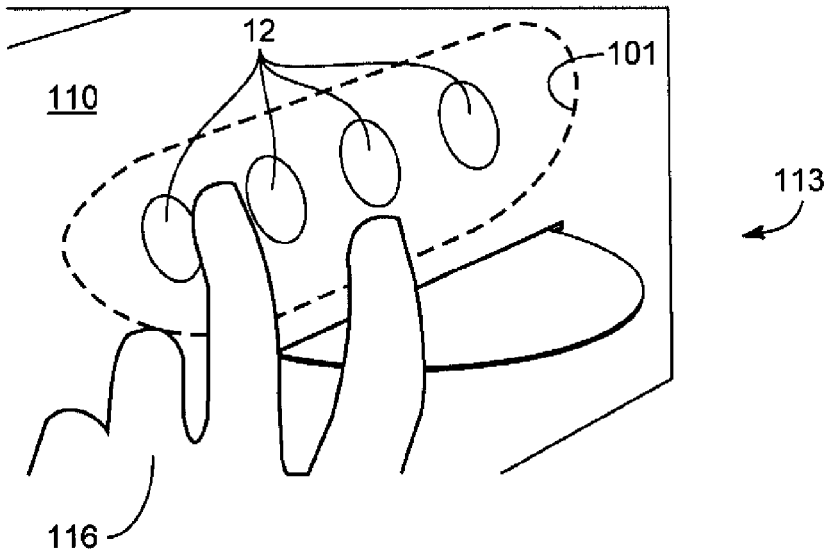

FIGS. 4A-4D are diagrammatic perspective views of an electronic control panel 110 forming part of a system 113 incorporating the configuration-adjusting mechanism 12 of FIGS. 1A-3B. Thus, FIGS. 4A-4D depict an application for the configuration-adjusting mechanism 12. A user's hand 116 is shown accessing the control panel 110, in this case for a CD, as indicated by CD port 119. In FIG. 4B, buttons 122 have been caused to emerge from a surface of the control panel such as by distorting cover 101 when underlying mechanisms 12 are moved from the non-deployed to the deployed configuration. Prior to actuation of these buttons, the control panel has a relatively unbroken, clean extent that is aesthetically pleasing. Actuation that causes the buttons 122 to emerge may be effected by a mechanical lever and/or an electrical switching mechanism that actuates the mechanisms 12 that are supported on a housing of the control panel 110 under the cover 101. The user can then engage appropriate buttons 122 for ejecting, skipping forward, controlling volume, etc., as shown in FIG. 4C. FIG. 4D shows a cutaway view exposing the configuration-adjusting mechanisms 12 under the cover 101 of the control panel 110.

Another application includes a reconfigurable user interface for input devices like the control panel 110 of FIGS. 4A-4D. Many input devices have arrays of push buttons for user input. However, as electronics have become smaller and more complex, the associated input devices are expected to become more compact and to fulfill multiple functions. Hence, the control panel could have different sets of buttons 122 actuated for different functions, which might include the CD, a radio, and air conditioning controls, for example. For this purpose, LEMs forming the configuration-adjusting mechanisms as described above can be configured in an array of mechanisms to create an interface that is compact and reconfigurable for the different functions. As may be appreciated, different parts of the array will be visible and active for different functions.

Figure 5:
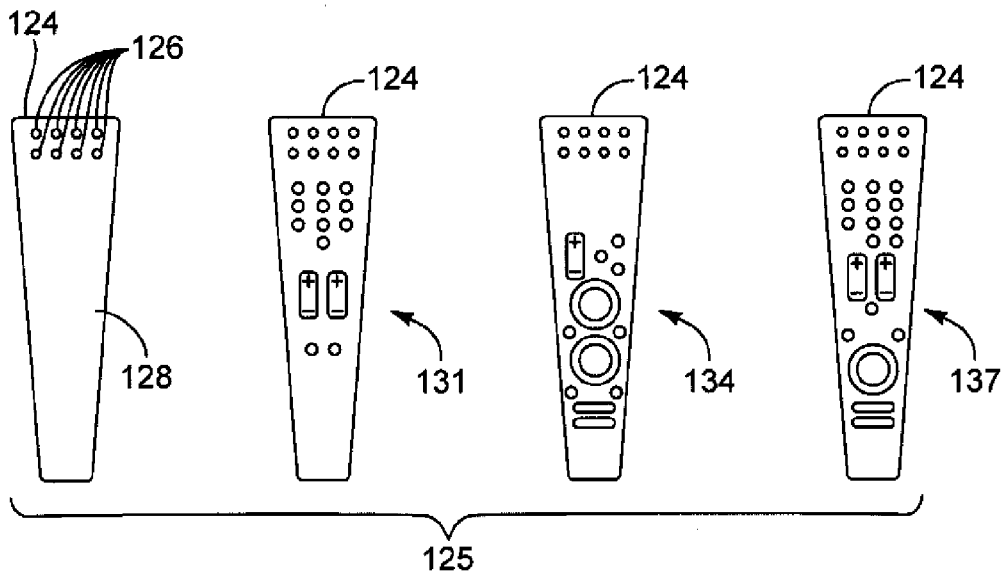
FIG. 5 is a diagrammatic top plan view of a remote control device in which the mechanism of FIGS. 1A-3B is actuated to provide four different configurations in accordance with another example application.

FIG. 5 is a diagrammatic top plan view of a remote control 124 in which the mechanism 12 of FIGS. 1A-3B is actuated to provide a variety of different configurations 125 in accordance with another reconfiguration application. The four configurations shown are examples, and it is to be understood that the possibilities for reconfiguration are almost limitless. In the Example of FIG. 5, conventional buttons 125 enable a user to select a desired function associated with a respective device to be controlled. A "base on" configuration 128 shows a smooth surface on the remote control in which no function or device has been selected. In a TV configuration 131, underlying configuration-adjusting mechanisms like mechanism 12 described above cause appropriate buttons for controlling a TV to emerge. Similarly, in a DVD configuration 134 or a VCR configuration 137 may be selected by pressing the appropriate button 126. The buttons 126 may be configured to allow only one function/device at a time. Alternatively, the remote control 124 may be configured to cause two or more configurations to emerge when requested. It is noted that the different configurations include emerging buttons of different shapes, sizes, and contours. The LEMs principles and design avenues referred to herein enable a variety of shapes, sizes, and arrays. Like the cover 101 shown and described in FIGS. 3A-4D, a cover layer on the remote control 124 may provide the ability for the device to appear to morph from a two-dimensional surface into a three-dimensional contour, or to morph from one three-dimensional contour to another three-dimensional contour.

Figure 6:
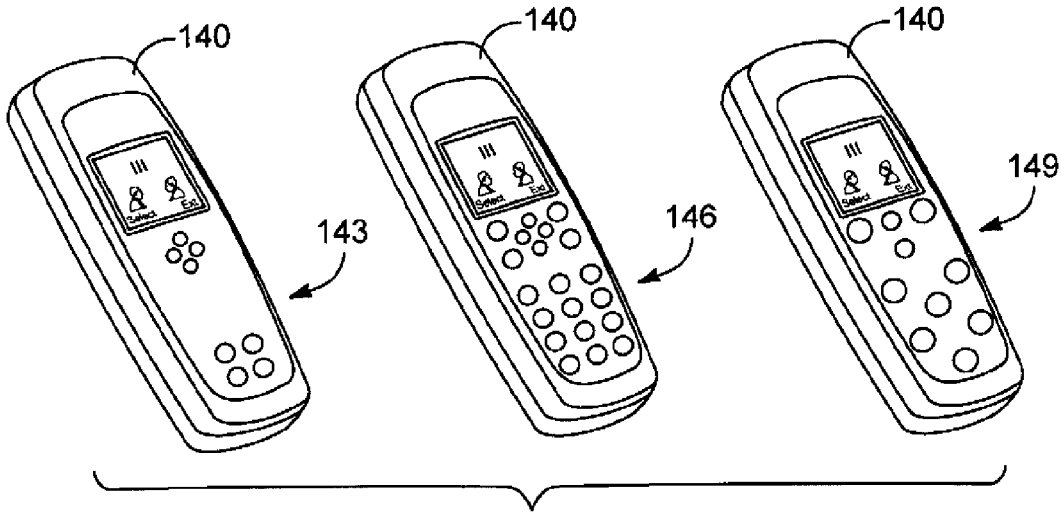
FIG. 6 is a diagrammatic perspective view of a cell phone in which the mechanism of FIGS. 1A-3B is actuated to provide three different configurations in accordance with another example application.

FIG. 6 is a diagrammatic perspective view of a cell phone 140 in which the configuration-adjusting mechanism of FIGS. 1A-3B is actuated to provide three different example configurations 143, 146, 149 in accordance with another application. A configuration in which the buttons have not been actuated can act as a key guard. As with the application of the remote control 124, the cell phone 140 has multiple functions to which the button configuration can be adjusted. With small hand-held and other devices, reconfiguring between configurations for different functions enables the buttons for a particular function to be disposed in a non-crowded array. Different patterns of emerging buttons may be provided for a particular function or simply for user preference purposes, and may be selected based on user preference. Furthermore, as an alternative to ringing or phone vibration, for example, a pattern of buttons may be caused to emerge from the surface to provide a visual indicator of an incoming call. The same or a distinct pattern of buttons could provide a visual indicator of an alarm. A particular pattern could provide a visual indicator of a call from a particular caller. Alternatively, a changing pattern of emerging buttons could indicate a type of call or a particular caller. The patterns and sequences of emerging buttons may display letters or words for visual and/or tactile perception by a user.

Figure 7:
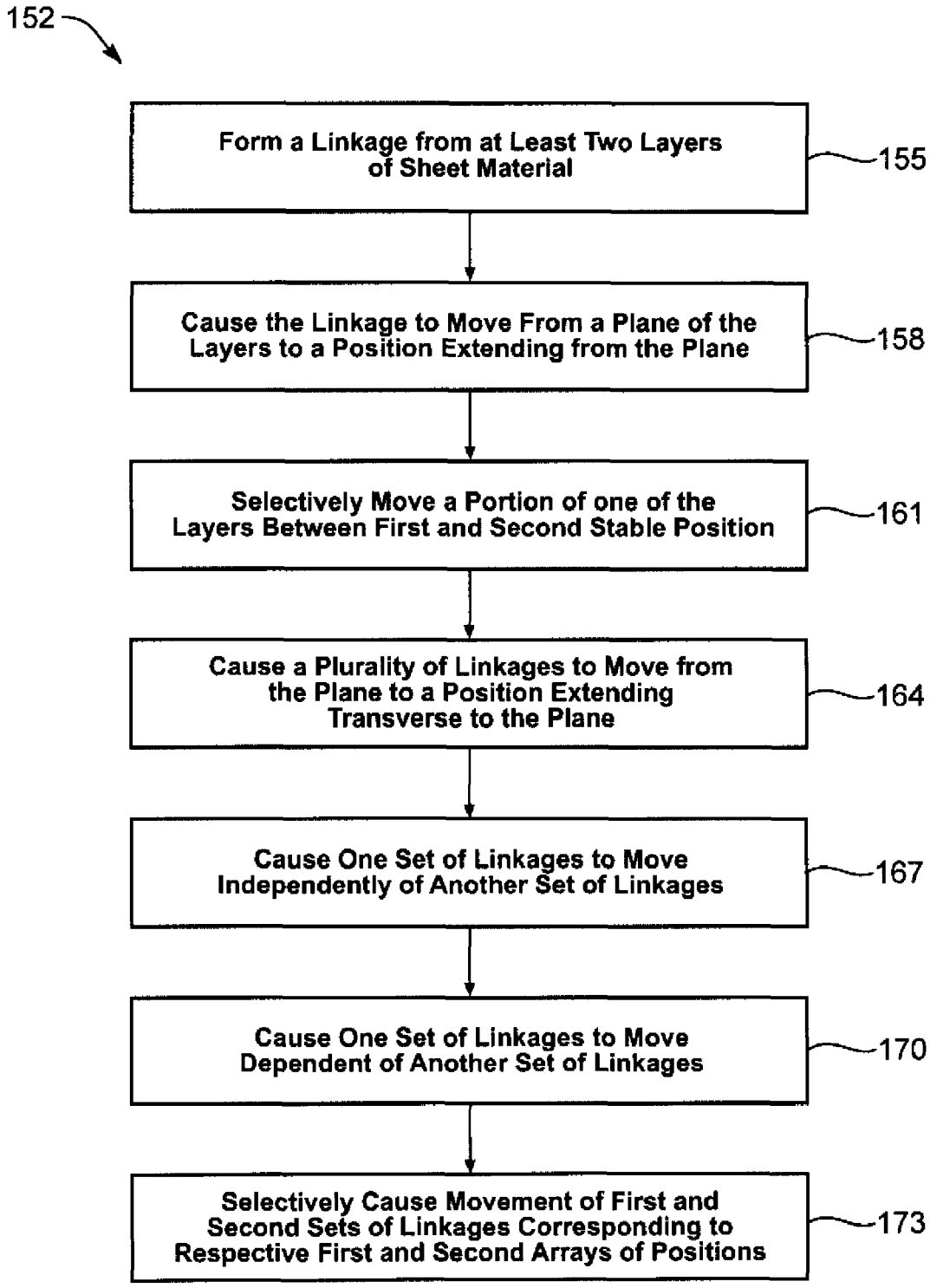
FIG. 7 is a block diagram illustrating an embodiment of a method.

FIG. 7 is a block diagram illustrating an embodiment of a method 152 for providing a configuration-adjusting mechanism. The method 152 includes forming a linkage from at least two layers of a sheet material as indicated at 155. The method also includes causing the linkage to move from a plane of the layers to a position extending from the plane, as indicated at 158. In some embodiments, the method may include moving a portion of one of the layers between two stable positions such as in a non-deployed configuration and a deployed configuration, as indicated at 161. The method may be applied to a plurality of linkages in a plane or surface of a user interface, as indicated at 164. An array of linkages may have different distinct sets associated with different button patterns, for example. The method may include causing one set of linkages to move independently from another set of the linkages in the array, as indicated at 167. Alternatively or additionally, the method may include causing one set of linkages to move dependent on a position and/or configuration of another set of the linkages as indicated at 170. Multiple sets of the linkages may be implemented on any user interface. Different arrays of positions corresponding to patterns of emerging buttons may be provided. Thus, the method may include causing movement of first and second sets of linkages corresponding to respective first and second arrays of positions, as indicated at 173.

Systems in accordance with embodiments of the present invention may include housings for the various control panels including remote controls, cell phones, and other devices, which may include a wide variety of structures and elements. However, it is to be understood that a mounting surface for the configuration-adjusting mechanisms may be located at any position on the housing including on an inside, back, or front. The configuration-adjusting mechanisms may be positioned to cause portions thereof to extend out of the plane.

While, the configuration-adjusting mechanisms have been described as being formed of two or more layers of a sheet material, it is to be understood that similar mechanisms maybe created from a single layer which, through its compliant characteristics, is made to function like the mechanisms described herein. One way to achieve this is through injection molding or similar processes. In any case, the mechanisms may be monolithic or one-piece. Alternatively, the mechanisms may be made to be monolithic by coupling the layers and portions thereof so that all the elements of the mechanism are integrally connected and the only relative movement between elements is due to the compliant nature of the layer(s).

While the contour adjustment has been described in terms of configuration adjustment, alternative expressions for the adjustments or changes that are caused by the mechanisms of the present invention may include mechanisms for texturing, or mechanisms for changing a surface texture of a device. An array of positions for the configuration-adjusting mechanisms or arrays of mechanisms corresponding to predetermined patterns of emergent buttons to be actuated enable changing the texture or contour of a device.

The term mechanism is used herein as referring primarily to the configuration-adjusting mechanism. However, one definition of a mechanism is a device that transfers, translates, or imparts movement. In this sense the elements referred to primarily as linkages are also mechanisms. Thus, the term mechanism is to be taken in the context of the particular portion of the disclosure, and in the context of the disclosure as a whole. The term linkage is to be taken to include linkages with rigid elements at the joints as well as compliant mechanisms that impart forces and motion in a manner constrained by the specific structure and characteristics of the material providing the compliant mechanisms. Thus, it is to be understood that the coupling of the tabs described herein to each of two layers enables forces and motion to be transferred through a compliant material interconnecting the tabs. The interconnecting material may be in and form part of at least one of the layers such that the coupling of the tabs forms a linkage out of at least portions of two layers of a sheet material.

The number and variety of applications in which embodiments of the present invention may be applied is unlimited. Example categories include those described above, aerospace components, and medical implants. In particular, embodiments of the present invention could be applied to devices that are compact during transport and then deployed when at the location of operation. This may include surgical devices, mechanisms intended for use in space, and components for search and rescue operations. The embodiments may also help meet a need for compact packaging and shipping, such as for high-volume packaging that reduces costs associated with handling, storing, and shipping products. The embodiments of the present invention may be applied in situations with limited manufacturing processes available. For example, the embodiments may be applied to microelectromechanical systems (MEMS) and other applications that are cost-sensitive.

One of the advantages of forming the mechanisms of the embodiments described herein as LEMs is that LEMs are manufactured in a plane having a flat initial state. Another advantage is that LEMs are monolithic, or can be made monolithic. Furthermore, LEMs lend themselves to interaction of a plurality of LEMs.

Since the embodiments of the mechanisms of the present invention can be fabricated from a single planar layer of sheet material, simplified processes can be used to manufacture the mechanisms. The ability to utilize sheet material provides the opportunity to use any of a large variety materials including sheet plastic and sheet metal, which are available in high-quality at low cost. At the micro level, advantages of single-layer MEMS fabrications include the inherent cost savings and reliability advantages. At the macro level, the layers maybe cut or otherwise processed by stamping, fine blanking, laser cutting, water jet cutting, plasma cutting, and/or plasma cutting, and wire electrical discharge machining (EDM). In any case, layers of sheet material can be used to create mechanisms capable of sophisticated motions and complex tasks including movement from a flat or non-deployed condition into distinct configurations such as to form distinct contours. It is to be understood that in some embodiments, the non-deployed condition may be a non-flat configuration. Nevertheless, the mechanisms may be monolithic or made to be monolithic.

Although the mechanisms and their linkages in accordance with embodiments of the present invention could be made with rigid coupling elements or rigid pin joint linkages, one-piece or monolithic and compliant linkages have certain advantages. For example, backlash and wear associated with typical pin joints can be avoided by incorporating monolithic, compliant mechanisms instead. Also, the monolithic, compliant mechanisms are lighter in weight and reduce or eliminate friction. Furthermore, an amount of assembly can be reduced by forming the mechanisms of monolithic, compliant linkages, which may form part of one or both of the layers.

Many materials may be used to form the layers in the embodiments of the present invention. For example, polypropylene was used for the prototypes upon which the embodiments of FIGS. 1A-3B are based. Polypropylene or any of a variety of other plastics, metals, fabrics, and composites may be utilized. Of particular interest are those materials that are capable of forming living hinges by thinning the material in localized areas in which articulation is desired.

It is to be understood that the term linkage, as used herein, is not to be limited to any particular linking mechanism. For example, even though linkages are sometimes considered to include rigid elements in the joints, the term "linkage" as used herein includes compliant coupling mechanisms in which the flexibility of all or part of the linking elements allows articulation, force transfer, and other linkage functions that are important for movably coupling at least two elements together.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A mechanism capable of being transformed from a planar to a non-planar configuration, the mechanism comprising:

a first layer;

a second layer;

at least one linkage interconnecting the first and second layers;

wherein the layers are bi-stable with respect to each other wherein the layers are flat and generally define a plane in a first of two stable positions and a portion of at least one of the layers projects out of the plane in a second of the two stable positions.

2. The mechanism of claim 1, wherein the layers are compliant, and the linkage comprises a portion of at least one of the first and second layers.

3. The mechanism of claim 1, wherein the at least one linkage is a first linkage of a plurality of linkages that interconnect the first and second layers.

4. The mechanism of claim 1, wherein the mechanism is spherical in the second of the two stable positions.

5. The mechanism of claim 1, further comprising at least one bi-stable biasing mechanism for biasing the second layer into each of the two stable positions relative to the first layer.

6. An apparatus for changing a position or contour of a surface, the apparatus comprising:

at least one configuration changing mechanism having first and second layers coupled together and movable relative to each other; and a cover supported on the at least one mechanism, a surface on the cover having a first position, the surface on the cover being adjustable to a second position by moving the at least one mechanism from a first configuration to a second configuration.

7. The apparatus of claim 6, further comprising a plurality of mechanisms including the at least one mechanism.

8. The apparatus of claim 6, further comprising at least one actuator coupled to the configuration changing mechanism, the actuator configured to move the first and second layers between first and second positions.

9. The apparatus of claim 8, further comprising:

a plurality of configuration changing mechanisms including the at least one configuration changing mechanism; and a plurality of actuators including the at least one actuator;

wherein the actuators are coupled to respective distinct sets of the configuration changing mechanisms among the plurality of configuration changing mechanisms for selectively moving the distinct sets of configuration changing mechanisms.

10. The apparatus of claim 9, wherein the plurality of actuators are independently coupled and are configured to independently actuate the respective sets of configuration changing mechanisms.

11. A system including a configuration-adjusting mechanism; the system comprising:

a base layer;

an actuation layer movably coupled to the base layer;

at least one linkage coupled to each of the base layer and the actuation layer; and an actuator coupled to the actuation layer for moving the actuation layer between first and second positions;

wherein the base layer, actuation layer, and at least one linkage form an ortho-planar configuration-adjusting mechanism.

12. The system of claim 11, wherein the actuation layer is rotatably coupled to the base layer.

13. The system of claim 11, wherein the base layer, the actuation layer, and the at least one linkage form a spherical mechanism.

14. The system of claim 11, wherein the base layer, the actuation layer, and the at least one linkage form a compliant mechanism.

15. The system of claim 11, wherein the first and second positions are stable positions, the system further comprising a biasing mechanism, wherein the biasing mechanism, the base layer, the actuation layer, and the at least one linkage form a bi-stable mechanism for moving the actuation layer between the first and second positions.

16. The system of claim 11, further comprising an electronic device having a housing, wherein the ortho-planar configuration-adjusting mechanism is supported on the housing.

17. The system of claim 11, further comprising a plurality of linkages including the linkage, the plurality of linkages configured to extend transversely from a plane of the ortho-planar configuration-adjusting mechanism, wherein the plurality of linkages correspond to an array of positions in the plane.

18. The system of claim 17, wherein the plurality of linkages comprises at least a first set of the linkages in the array of positions and a second set of linkages in the array of positions, the first and second sets of linkages operatively connected to the actuator for independent actuation of the first and second sets of the linkages in the array of positions.

19. The system of claim 17, wherein the plurality of linkages comprises at least one set of linkages in the array of positions dependently coupled to another set of linkages in the array of positions for dependent actuation or movement of the sets of the linkages in the array of positions.

20. The system of claim 17, wherein the array of positions comprises a plurality of patterns, the system further comprising a first set of linkages corresponding to one of the patterns and a second set of linkages corresponding to another of the patterns.

* * * * *